US006425736B1

(12) United States Patent
McMahon et al.

(10) Patent No.: US 6,425,736 B1
(45) Date of Patent: Jul. 30, 2002

(54) STATOR ASSEMBLY FOR A ROTARY MACHINE AND METHOD FOR MAKING THE STATOR ASSEMBLY

(75) Inventors: Michael E. McMahon, Shapleigh; Carl S. Richardson, South Berwick; Dennis R. Tremblay, Biddeford, all of ME (US); Jeffrey S. LeShane, Glastonbury; Charles R. Watson, Windsor, both of CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/629,307

(22) Filed: Jul. 31, 2000

Related U.S. Application Data

(60) Provisional application No. 60/147,978, filed on Aug. 9, 1999.

(51) Int. Cl.[7] ..... F01D 11/08

(52) U.S. Cl. ..... 415/173.4; 415/174.4

(58) Field of Search ..... 415/174.4, 173.4, 415/173.5, 174.5, 230

(56) References Cited

U.S. PATENT DOCUMENTS

| | | | | |
|---|---|---|---|---|
| 3,326,523 A | | 6/1967 | Bobo | 253/78 |
| 3,997,280 A | * | 12/1976 | Germain | 415/189 |
| 4,395,195 A | | 7/1983 | De Cosmo et al. | 415/137 |
| 5,707,207 A | * | 1/1998 | Benoist et al. | 415/173.4 |
| 5,858,521 A | * | 1/1999 | Okuda et al. | 428/219 |
| 6,203,273 B1 | * | 3/2001 | Weiner et al. | 415/174.4 |

* cited by examiner

*Primary Examiner*—Edward K. Look
*Assistant Examiner*—James M. McAleenan
(74) *Attorney, Agent, or Firm*—Gene D. Fleisehhauer

(57) ABSTRACT

A stator assembly having an inner shroud assembly formed of an inner shroud and rubstrip is disclosed. Various construction details and features are developed which relate to durability and manufacturing feasibility are developed. In one detailed embodiment, at the rubstrip is bonded to the thermoplastic shroud. The method is applicable to joining an elastomer, such as silicone rubber material, to a thermoplastic substrate.

22 Claims, 4 Drawing Sheets

FIG.3
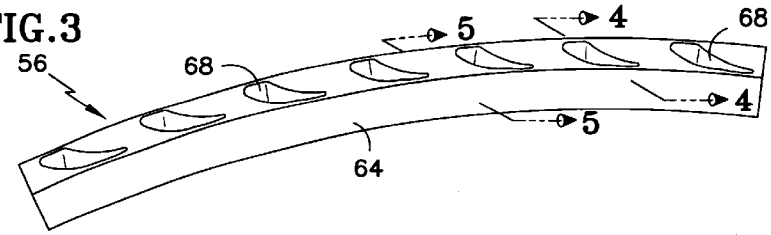
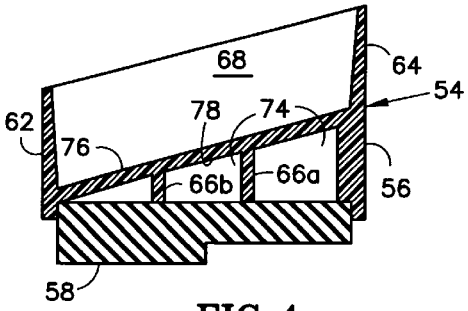
FIG.4
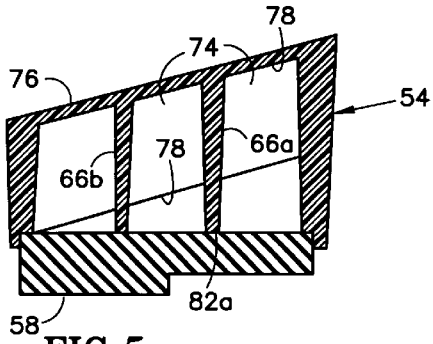
FIG.5
FIG.6
Prior Art
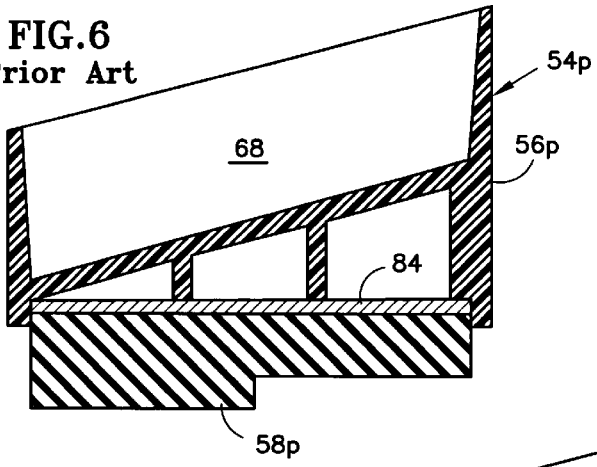
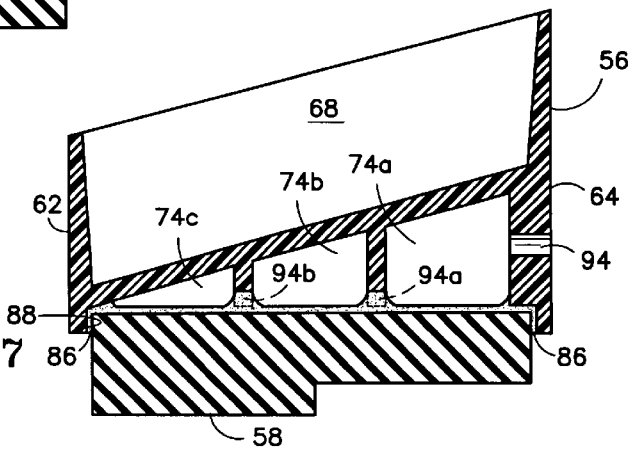
FIG.7

STATOR ASSEMBLY FOR A ROTARY MACHINE AND METHOD FOR MAKING THE STATOR ASSEMBLY

This application claims benefit from U.S. Provisional Application Serial No. 60/147,978 filed on Aug. 9, 1999.

TECHNICAL FIELD

This invention relates to a stator structure of the type used in rotary machines, and more specifically, to structure within the compression section to guide working medium gases through the section.

BACKGROUND OF THE INVENTION

An axial flow rotary machine, such as a gas turbine engine for an aircraft, has a compression section, a combustion section, and a turbine section. An annular flow path for working medium gases extends axially through the sections of the engine. The gases are compressed in the compression section to raise their temperature and pressure. Fuel is burned with the working medium gases in the combustion section to further increase the temperature of the hot, pressurized gases. The hot, working medium gases are expanded through the turbine section to produce thrust and to extract energy as rotational work from the gases. The rotational work is transferred to the compression section to raise the pressure of the incoming gases.

The compression section and turbine section have a rotor which extends axially through the engine. The rotor is disposed about an axis of rotation Ar. The rotor includes arrays of rotor blades which transfer rotational work between the rotor and the hot working medium gases. Each rotor blade has an airfoil for this purpose which extends outwardly across the working medium flow path. The working medium gases are directed through the airfoils. The airfoils in the turbine section receive energy from the working medium gases and drive the rotor at high speeds about an axis of rotation. The airfoils in the compression section transfer this energy to the working medium gases to compress the gases as the airfoils are driven about the axis of rotation by the rotor.

The engine includes a stator disposed about the rotor. The stator has an outer case and arrays of stator vanes which extend inwardly across the working medium flowpath. The stator extends circumferentially about the working medium flow path to bound the flow path. The stator includes seal elements for this purpose. An example is an inner shroud assembly having a circumferentially extending seal member (rubstrip) which is disposed radially about rotating structure and supported from. the vanes by an inner shroud. The rubstrip is in close proximity to the rotor structure to form a seal that blocks the leakage of working medium gases from the flowpath. The rubstrip for such shrouds may be formed of an elastomeric material. The elastomeric material may be disposed in uncured form on a metal, arcuate support surface. As the elastomeric material cures, the material bonds to the metal surface. The uncured elastomeric material is in fluid form (that is, assumes the shape of the container in which it is disposed) and is sticky. As a result, the uncured material may be difficult to handle and often requires extensive cleanup after use.

Examples of suitable candidate materials for use in high bypass commercial jet engines are injection molded thermoplastic materials which have been used for example in vane shrouds in exit guide vane and low-pressure compressor stator assemblies for approximately twenty years. Suitable elastomeric materials include silicone rubber which also has been in service during that period as an encapsulant to provide vane attachment and for damping functions.

However, a silicone rubber rubstrip supported by a substrate which is positioned by stator vanes or other structure must tolerate severe rubs from rotating structure. Such rubs may occur during normal operative conditions or abnormal operative conditions which might occur such as after an impact by a foreign object against the engine. The rubstrip must tolerate the severe rub without delaminating (a non-cohesive failure) and moving into the flow path.

The above notwithstanding, scientists and engineers working under the direction of Applicants Assignee have sought to develop bonding systems for elastomeric materials, such as silicone rubber, for rubstrips used with stator vanes for the compression section of rotary machines with acceptable levels of durability and handling difficulty.

SUMMARY OF THE INVENTION

According to the present invention, a stator assembly is formed of a preformed circumferentially extending rubstrip which is bonded to an inner shroud by directly applying adhesives and primers between the shroud and the preformed rubstrip.

In accordance with one detailed embodiment, the shroud is a thermoplastic material, the rubstrip is preformed silicone rubber and an epoxy resin primer is provided for interacting with the thermoplastic material.

In accordance with another detailed embodiment, the preformed rubstrip is deflected radially inwardly during the method of making the assembly to cause the bond to extend in a vertical or spanwise direction to increase the shearing strength at the interface.

In accordance with one detailed embodiment, the inner shroud has a plurality of chambers bounded by the rubstrip and sealed by the bonding material and the chambers are in flow communication through one more openings with a source of pressurized gas for testing the strength of the bond between the rubstrip and the inner shroud.

According to the present invention, a method for bonding a preformed silicone rubber article to a thermoplastic substrate includes applying an epoxy resin primer to the substrate.

In accordance with one detailed embodiment of the present invention, the method includes applying a silicone rubber primer to the epoxy resin primer after curing the epoxy resin primer.

In accordance with a detailed embodiment, the epoxy resin primer contains a solvent which chemically reacts with the thermoplastic material.

A primary feature the present invention is a preformed rubstrip for a stator assembly. Another feature is a stator assembly, such as an inner shroud assembly, formed by bonding the preformed rubstrip to the inner shroud. In one embodiment, the shroud includes ribs. In one embodiment, a feature is a bond material for a preformed silicone rubber article and a thermoplastic substrate which includes epoxy resin and silicone rubber. A primary feature of the method includes curing the epoxy resin primer which is applied to a thermoplastic substrate prior to adding a layer of silicone rubber primer before bonding a silicone rubber article to the substrate.

An advantage of the present invention is the ease of making a shroud assembly by bonding a preformed elastomeric rubstrip to a shroud which results from not applying an uncured elastomeric material to the shroud. Another advantage is the bond strength that exists between a preformed silicone rubber rubstrip and the supporting inner shroud formed of thermoplastic material which results in part from the bonding material and, in one embodiment, from the bond material extending between axially facing surfaces on the shroud and on the rubstrip. In one embodiment, an advantage is the ability to nondestructively test the bond between a rubstrip and the shroud by pressurizing chambers bounded by the shroud and sealed by the bond material.

The foregoing features and advantages of the present invention will become more apparent in light of the following detailed description of the best mode for carrying out the invention and accompanying drawings.

BRIEF DESCRIPTION OF THE DRAWINGS

FIG. 3 is a perspective view of part of the inner shroud assembly of the embodiment shown in FIG. 2.

FIG. 4 is a schematic cross-sectional view taken along the lines 4—4 of FIG. 3.

FIG. 5 is a schematic cross-sectional view taken along the lines 5—5 of FIG. 3.

FIG. 6 is a perspective view of a prior art construction.

FIG. 7 is a cross-sectional schematic view of the present invention at the location shown in FIG. 6.

BEST MODE

Figure 1:
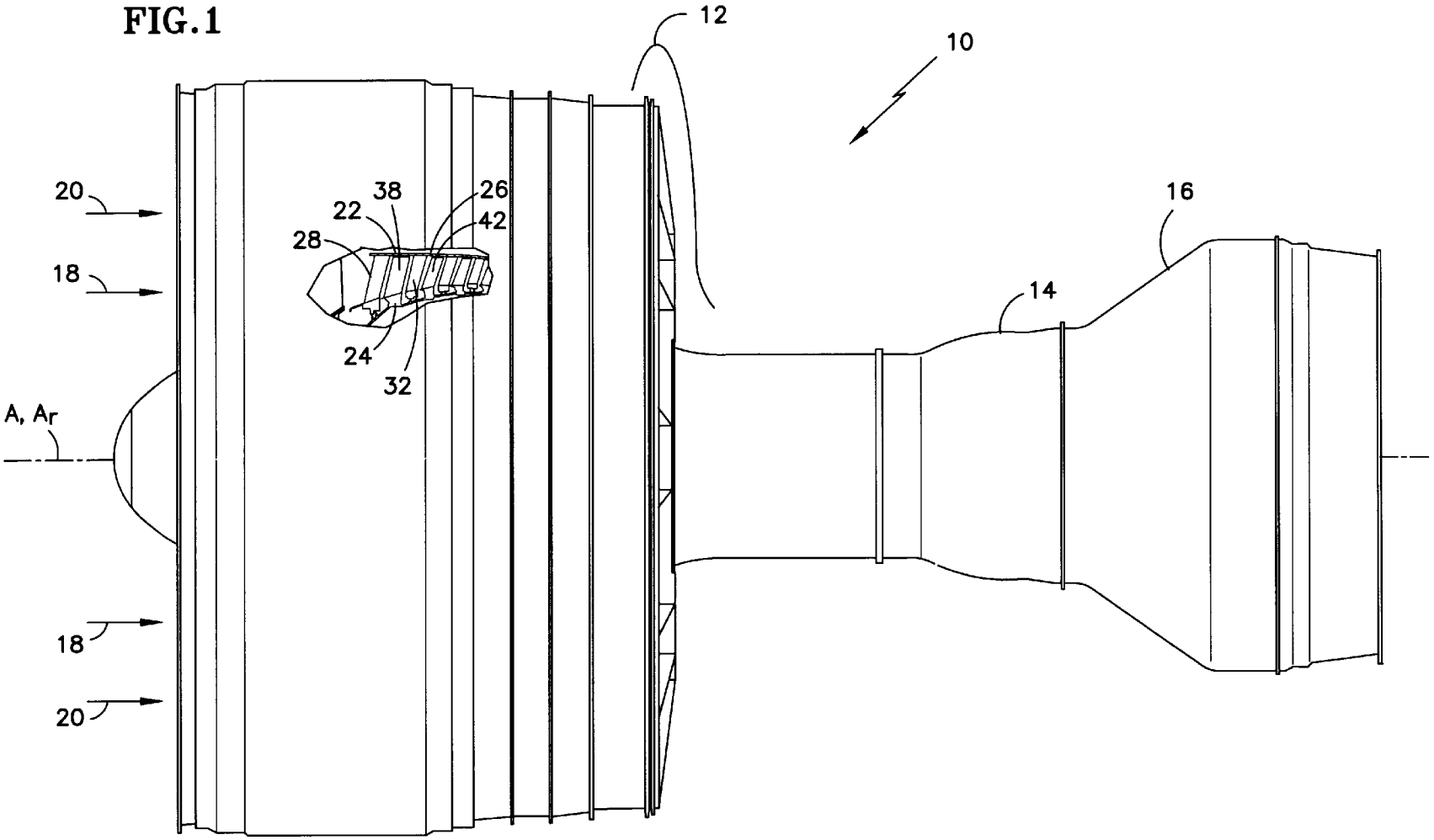
FIG. 1 is a schematic side elevation view of a gas turbine engine with portions of the engine broken away to show the compression section of the engine.

FIG. 1 is a schematic, side elevation view of a rotary machine 10, such as a turbofan gas turbine engine. The engine is disposed about an axis of symmetry A and has an axis of rotation Ar. The engine includes a compression section 12, a combustion section 14, and a turbine section 16. An annular, primary flowpath 18 for working medium gases extends axially through the sections of the engine. A by-pass flowpath 20 is outward of the primary flow path.

The engine is partially broken away to show a stator 22 and a rotor 24 in the compression section 12. The stator 22 includes an outer case 26 which extends circumferentially about the primary flowpath. The stator includes arrays of stator vanes, as represented by the stator vane 28 and the stator vane 32 in the compression section.

Figure 2:
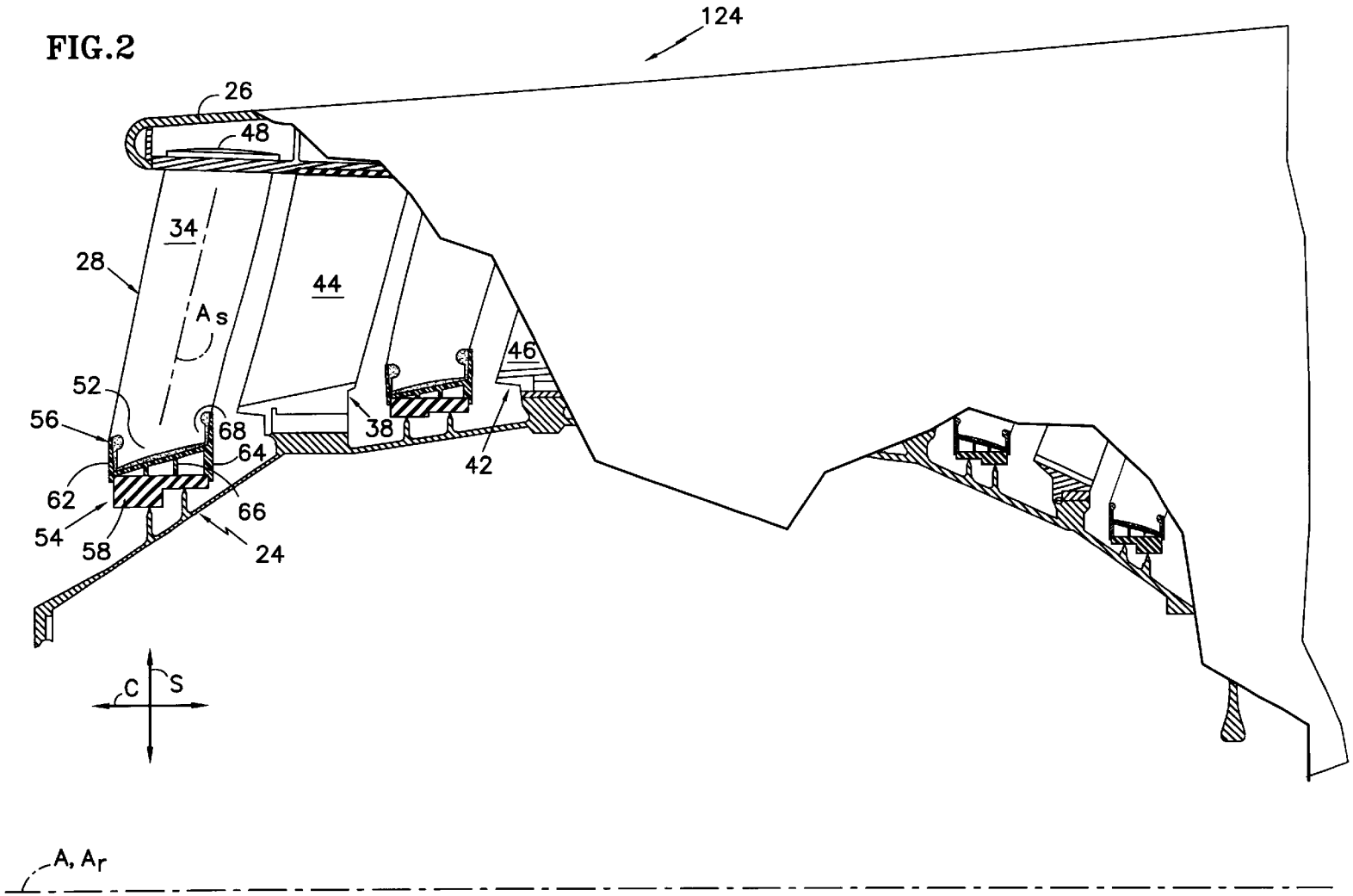
FIG. 2 is a side elevation view of a portion of the compression section shown in FIG. 1

FIG. 2 is an enlarged side elevation view of a portion of the engine shown in FIG. 1 which is partially in section and broken away for clarity. Each stator vane 28, 32 has an airfoil, as represented by the airfoil 34 and the airfoil 36. The airfoils extend inwardly from the outer case to direct the flow of working medium gases as the gases pass through the compression section and the turbine section.

As shown in FIG. 1 and FIG. 2, the rotor has arrays of rotor blades, as represented by the rotor blade 38 and the rotor blade 42 in the compression section 12. Each rotor blade has an airfoil, as represented by the airfoil 44 and the airfoil 46. The rotor blade airfoils extend radially outwardly across the working medium flow path into close proximity with the stator 22.

FIG. 2 shows the first array of stator vanes 28 extending radially inwardly from the outer case 26. Each vane 28 is disposed about a spanwise axis As which extends in a generally radial direction. The vane has a base 48 and a vane tip 52. The vane tip is an extension of the airfoil. A plurality of airfoil sections are disposed chordwisely about the spanwise axis As to define the contours of the airfoil (as used herein, plurality means an indefinite number of two or more). The airfoil has a chordwise direction C and a spanwise direction S that provide reference directions. The spanwise direction is generally perpendicular to the axis of rotation Ar.

An inner shroud assembly 54 extends circumferentially about the axis of rotation Ar and outwardly of the rotor. The inner shroud assembly might be circumferentially continuous or circumferentially segmented. The inner shroud assembly includes an inner shroud 56 and a rubstrip 58. The rubstrip 58 is formed of an elastomeric material 58, such as silicone rubber, which is bonded to the inner shroud. The rubstrip is preformed (that is, fabricated prior to installation by being formed and cured) prior to being disposed adjacent to the inner shroud and bonded to the shroud.

The inner shroud 56 is formed of a thermoplastic material. The inner shroud has a pair of axially spaced walls, as represented by the upstream wall 62 and the downstream wall 64. One or more ribs 66 extend in a generally radial direction and circumferentially for a limited extent to engage the silicone rubber rubstrip. The tip 52 of the stator vane 28 extends radially through at least part of the shroud to support the inner shroud. The inner shroud has openings between the walls, as represented by the opening 68, each for receiving the tip of an associated stator vane. An elastomeric material (not shown) is disposed between the vane and the inner shroud to bond the vane to the inner shroud.

FIG. 3 is a perspective view of the inner shroud 56 showing the openings 68 in the inner shroud. The openings are circumferentially spaced one from the other and extend in a generally axial direction. Each opening is bounded by an airfoil shaped wall 72. The airfoil shaped wall adapts the inner shroud to receive elastomeric material and provides structure for joining the tip of the associated stator vane to the inner shroud.

As shown in FIG. 4 and FIG. 5, the ribs 66*a*, 66*b* and the walls 62, 64 extend from the inner shroud. The ribs and walls form a plurality of chambers 74 which are bounded by the preformed rubstrip 58. A cap wall 76 has an outwardly facing surface 78 which radially bounds the opening 68. The ribs 66 extend from the cap wall, terminating at a tip surface 82 of the rib. As shown in FIG. 5, the ribs extend radially from the cap wall and circumferentially between adjacent openings.

FIG. 6 is an illustration of a prior art embodiment of a shroud assembly 54*p* having a circumferentially extending aluminum band 84 which is attached to the inner shroud 56*p*. The aluminum band provides a support for the rubstrip 58*p* after the rubstrip is formed. The attachment of the aluminum band to the inner shroud provided a bond joint which might fail.

The prior art method of forming the prior art embodiment includes the steps of molding uncured silicone rubber in place and thereafter curing the silicone rubber material. During the prior art method of forming the rubstrip, the aluminum band provides the bottom part of a form or mold for the uncured seal material and walls (not shown) for the mold extend from the inner shroud. The uncured seal material in viscous form is disposed in the mold as a sticky, slow flowing fluid, contacting the aluminum band. The method was difficult to carry out quickly and efficiently, especially when pouring the sticky, viscous silicone rubber fluid into large diameter forms. As the material cured, an adhesive bond formed between the aluminum band and the rubstrip material.

Using a preformed rubstrip which is not sticky and which is formed independent of the shroud provides handling advantages during manufacture; and, can provide structural integrity advantages during operative conditions with a rubstrip that is properly bonded to the inner shroud.

A preformed silicone rubber rubstrip is necessarily cured prior to installation. Accordingly, it is much easier to handle because it is not sticky. On the other hand, a particular problem with using a nonsticky silicone rubber rubstrip is reliably bonding (sticking) the rubstrip to the inner shroud. One approach is to use an adhesive between the silicone rubber rubstrip and the inner shroud. A problem with using an adhesive is the need to nondestructively test the bond between the rubstrip and the inner shroud both for strength and, along the walls, for continuity.

FIG. 7 is a schematic representation of the structure resulting when using an adhesive for forming strips of bond material 86 which extend between the silicone rubber rubstrip and the ribs and between silicone rubber rubstrip and the sides 86, 88 (of walls 62, 64) of the shroud. As shown, there are no natural mechanical features which attach the preformed rubstrip to the shroud other than the bond layer between the rubstrip and the inner shroud.

As shown in FIG. 7, the shroud assembly 54 has been modified to enable a method for nondestructively testing the finished construction. The inner shroud 56 has an opening 94 which extends through the inner shroud, such as through the downstream wall 64. The opening places the exterior of the shroud in flow communication through the opening with the interior chamber 74*a*. Each of the chambers 74*b*, 74*c* is linked in flow communication and thence to the exterior by openings 94*a*, 94*b*. These openings may extend in the inner end of the ribs as shown, or, near the outermost portion of the ribs. In some constructions, the outermost portion might be preferred because this spaces the opening from the bonding material 86. The openings and the connected chamber construction permits testing for bonding by flowing a gas, such as air or nitrogen, until the interior reaches a predetermined level of pressure. Thereafter, the length of time the chamber holds its pressure provides a measure of bonding material continuity and the strength of the bond. This ensures that an adequate bond exists between the premolded silicone rubber rubstrip and the ribs and between the upstream and downstream walls of the shroud. If the bond is insufficient or discontinuous, gases will leak and the structure may be modified to an acceptable condition.

Figure 8:
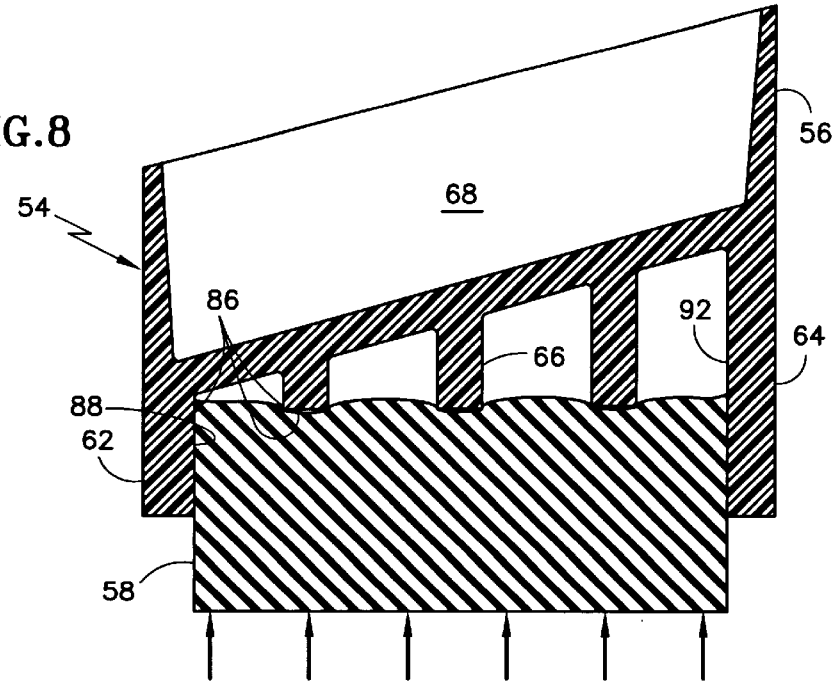
FIG. 8 is a schematic cross-sectional view illustrating a step in the method of forming the shroud assembly.

FIG. 8 shows one of the steps in the method of bonding the preformed silicone rubber rubstrips 58 to the ribs 66 and to the sides 88, 92, respectively on theupstream wall 62 and the downstream wall 64 of the shroud. A force is applied, preferably distributed over the surface, against the rubstrip 58. The rubstrip is pressed down, onto and against the ribs 66 of the shroud such that the preformed rubber material extends beyond the tip surfaces 82 of the ribs 66 and between adjacent ribs.

Figure 9:
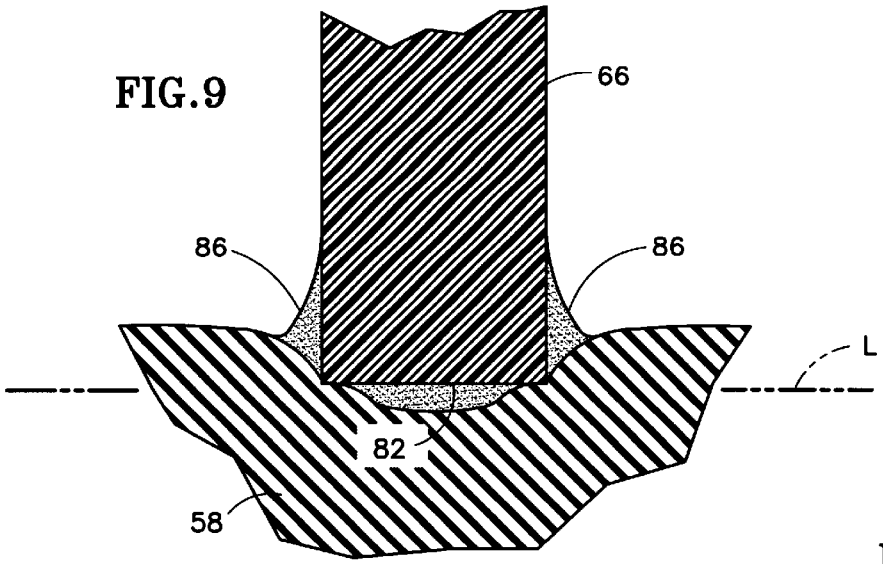
FIG. 9 is a schematic enlarged view of a portion of FIG. 8.

As shown in FIG. 9, the tip surface 82 of the rib 66 correspondingly appears to extend inwardly into the rubstrip 58. The tip surface 82 extends past the uninstalled location of the surface of the rubstrip as it rests on the rib prior to installation (shown by the phantom line L). The rib indents the surface of the preformed rubstrip. Bonding material 86 extends laterally and in a generally radial direction forming a vertical layer of bonding material 86 between part of the axially facing portions of the rib and the rubstrip. This vertical bond has been found much stronger in shear than the bond between the inner shroud and rubstrip that results from just attaching the rubstrip to the inwardly facing tip surface of the rib and other inwardly facing surfaces of the shroud.

Figure 10:
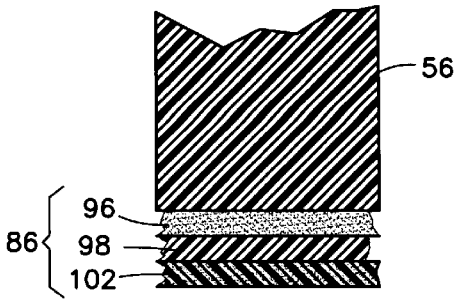
FIG. 10 is a schematic view showing the relative location of layers of materials applied to the inner shroud prior to steps shown in FIG. 8.

FIG. 10 is a schematic representation showing the relationship of layers of material used for the bond. During fabrication, the outermost material is the thermoplastic material of the inner shroud 56. A layer of epoxy resin primer 96 is applied. The epoxy resin primer includes epoxy resin dissolved in a solvent as will be discussed below. The epoxy resin primer is cured and the solvent evaporates leaving behind a surface which is prepared to bond to a silicone rubber primer 98.

Thereafter a silicone rubber primer 98 is applied. The silicone rubber primer bonds well to the epoxy resin primer 96 for reasons not fully understood. It is believed the epoxy resin primer and its solvent, when applied to the shroud, modifies the inert chemistry of the thermoplastic, and causes it to behave as a reactive thermoset. A silicone rubber adhesive 102, such as an adhesive in paste form, is disposed in turn between the premolded silicone rubber rubstrip and the mixture of the epoxy resin primer and silicone rubber primer. The silicone rubber adhesive is applied to the mixture of the two primers for bonding the rubstrip to the inner shroud. This might be done by applying the paste directly to the mixture of primers and then applying the rubstrip 58, or applying the paste to the rubstrip and then applying the rubstrip to the inner shroud. In either event, the rubstrip is pressed into place by a force exerted on the surface of the rubstrip as shown in FIG. 8.

As stated, FIG. 10 is a schematic representation of the layers. The relative size of the layers of epoxy resin may be much smaller than the layers shown in FIG. 10. These layers, particularly the layer of epoxy resin primer, may be difficult to detect in the finished product. In most products, the layer of epoxy resin primer may be detected by sophisticated techniques, such as photoelectron microscopic techniques, which detect the elemental materials that are present. It is possible that in some products the schematically shown separate layers of epoxy resin primer and silicone rubber primer (or the layer of the mixture of epoxy resin primer and silicone rubber primer which results) may not be detectable. However, the product will exhibit enhanced tensile bond strength.

Experience has shown that the bonding material 86 that is formed provides a much improved bond over the bond which occurs without an epoxy resin primer. Typical tensile tests of constructions not using the epoxy resin primer show limited bond strengths and primarily adhesive bond failure of the adhesive to the thermoplastic material. With addition of the epoxy resin primer, the same tests give a strength improvement of twice to four times with a nearly one hundred percent cohesive failure mode.

EXAMPLE

The following detailed method was used to form embodiments of the type shown in FIG. 2. The following is one detailed example of carrying out the method to form an embodiment of the type shown in FIG. 2 and does not limit the preceding disclosure. Not all steps need be performed for all constructions which bond a thermoplastic substrate to an elastomeric preformed member. In this example, the inner shroud 56 is formed of a thermoplastic material. Satisfactory materials for the shroud include material from the Ultem material family available from General Electric, Ultem Products Oper., Pittsfield, Mass., the EC-1000 or EF-1000 families from LNP Corp., Malvern, Pa., or the RTP-2000 family from RTP Corp., Winona, Minn. The materials have inert polymer molecular chains which do not easily bond to silicone rubbers. This is in part because the ends of the plastic molecules are not strong reaction sites and as a result are difficult to bond to a material.

The thermoplastic material, such as Ultem material, is modified prior to bonding with the silicone rubber rubstrip. This was done by applying an epoxy resin primer containing a solvent. The specific steps included light grit blasting the surface; cleaning the surface with alcohol; and, applying an epoxy resin primer with a thickness that is less than about one mil (0.001 inches). One class of epoxy resin primers found satisfactory is the class of epoxy resins that have glycidyl ether structures in the terminal positions, and which have many hydroxyl groups and cure readily with amines. Epoxy resin primers believed satisfactory include Epoxy resin primer BR-154 from Cytec Engineered Materials, Havre de Grace, Md.; or EA-9205 or EA-9205R from Dexter Corporation, Hysol Division, Pittsburg, Calif.

The epoxy resin was diluted with a solvent, for example methy-ethyl-ketone(MEK), such that the mixture of the epoxy resin primer and the solvent aided bonding of the epoxy resin primer to the thermoplastic shroud. The solvent when combined with the epoxy resin chemically promotes bonding between the mixture and the substrate. Although the bonding mechanism is not well understood, it is believed the MEK solvent aids in locally attacking the molecule ends, and allows the epoxy resin to react with a thermoplastic material. The MEK evaporates and is believed no longer part of the process. The mechanism is not complete until the epoxy resin primer is cured. The epoxy resin primer is approximately at least eighty (80) percent MEK solvent (by weight) and in one embodiment was about ninety (90) percent MEK solvent. Other candidate solvents include types such as ketones and partially chlorinated hydrocarbon. Alcohol may possibly be effective but has not been tested.

The thermoplastic shroud with the epoxy resin primer was then cured in an oven at three hundred fifty (350) degrees Fahrenheit for one hour. The cured epoxy resin primer layer was now an active surface for bonding.

The silicone rubber primer was then applied and chemically reacted with the epoxy resin primer. Satisfactory materials for the silicone rubber primers, for example, are DC-1200 Red or Clear from Dow Corning, Midland, Mich., or Visilox V-06 Red or Clear from Rhone-Poulenc, Troy, N.Y. The silicone rubber primer is set by air drying at room temperature for two hours in an environmentally controlled silicone clean room.

The inner shroud was ready to receive the silicone rubber adhesive in paste form after the epoxy was cured and the silicone rubber primer was set. The silicone rubber paste adhesive was applied to the silicone rubber rub strip and was then clamped to the rib structure of the inner shroud. Satisfactory materials for the silicone paste are adhesives such as V-612 from Rhodia Corporation (Rhone Poulenc), Troy, N.Y. or Thermosil 4000 from FMI Chemical, Manchester, Conn. Examples of other materials that are less viscous are materials such as Silastic J from Dow Corning, Midland, Mich.; Dapcocast 37 from D Aircraft Products, Anaheim, Calif.; and RTV 630 and RTV 668 from the General Electric Co., Waterford, N.Y. Materials for the silicone rubber molded rubstrip are Visilox V-622 from Rhodia (Rhone Poulenc), Troy, N.Y. or Dow Corning 3-6891 from Dow Corning, Auburn, Mich.

The silicone rubber rub strip and the rib structure of the inner shroud are clamped with pressure applied against the flat seal surface as shown in FIG. 8. The pressure on the rubstrip and adhesive paste creates "T" shaped joints as shown in FIG. 9. The silicone rubber adhesive paste may be trapped between the rubstrip and the tip surface of the rib which causes bonding at that location. Alternatively, the pressure may force the adhesive paste from this location. In either event, the adhesive forms fillets (that is, thin strips of bond material) or beads of bond material 86 at the crotches. The vertical side of the fillet bond material offers the most resistance during peel loading such as might occur as a portion of the rotor structure rubs against the rubstrip. The bond material engaging the vertical surface provides good shear strength to the structure, which is the key to good bond strength over and above that which occurs on flat-to-flat tensile bond geometry.

Tests were performed of the same embodiments with and without the epoxy resin primer. These tests showed approximately one hundred twenty (120) psi overlap tensile shear strength without the epoxy resin primer, and five hundred (500) psi with the epoxy resin primer. The failure mode is important and showed primarily adhesive failure without the epoxy resin primer, and completely cohesive failure with the epoxy resin primer.

While the bond improvement demonstrations utilized the materials referenced above, the mechanism for this improvement should be similar for any epoxy based primer dispersed in an organic solvent, when applied to any thermoplastic. Accordingly, this procedure provides for a low-cost method of constructing bonds between silicone rubber components, such as sealants or adhesives, and thermoplastic components.

Although the invention has been shown and described with respect to detailed embodiments thereof, it should be understood by those of ordinary skill in the art that various changes in form in detail thereof may be made without departing from the spirit and scope of the claimed invention.

We claim:

1. A stator assembly for a rotary machine having an axis A and having a plurality of stator vanes extending inwardly across a working medium flowpath, which comprises:

an inner shroud formed of a material which extends circumferentially with respect to the axis A and which is adapted to be attached to at least two of said stator vanes, the shroud having an upstream wall which extends circumferentially and radially, a downstream wall which extends circumferentially and radially and which is spaced axially from the upstream wall leaving a cavity therebetween, and at least one rib having an upstream side and a downstream side which extends circumferentially and radially and which is spaced from the walls leaving a chamber between the rib and the upstream wall and between the rib and the downstream wall;

a preformed, circumferentially extending rubstrip which is formed of a cured elastomeric material, which extends to bound said chamber and which is adapted to be bonded to the shroud by bond material;

an elastomeric bond material which extends from the shroud to the preformed rubstrip to bond the preformed rubstrip to the shroud;

wherein the bond material extends as a strip of material from at least one of said sides of the rib to the elastomeric rubstrip and wherein the bond material extends about at least a portion of the periphery of the rubstrip and between the rubstrip and shroud.

2. The stator assembly of claim 1 wherein the bond material forms a seal between the rubstrip and the shroud which is capable of blocking the leakage of gases and wherein the shroud has at least one opening which places the interior in flow communication with the exterior of the shroud and which adapts the stator assembly to receive pressurized gases for testing the strength of the bond between the shroud and the rubstrip.

3. The stator assembly as claimed in claim 1 wherein the preformed rubstrip is deflected radially into the chamber bounded by the rib during installation of the rubstrip to the shroud such that a portion of the rubstrip surface extends radially to face a radially extending portion of the rib and wherein the elastomeric bond material extends radially and axially between the rib and the preformed rubstrip to increase the shearing strength at the interface.

4. The stator assembly as claimed in claim 3 wherein the elastomeric bond material extends radially and axially between the radially facing surfaces of the rib and the preformed rubstrip.

5. The stator assembly as claimed in claim 1 wherein the preformed rubstrip is silicone rubber, wherein the shroud is formed of a thermoplastic material, and wherein the bond material is formed of material resulting from the mixture of an epoxy resin primer applied to the shroud, a silicone rubber primer applied to the epoxy resin primer, and a silicone rubber adhesive applied to the silicone rubber rubstrip.

6. The stator assembly as claimed in claim 1 wherein the bond material contains epoxy resin primer and silicone rubber.

7. The stator assembly as claimed in claim 1 wherein the stator assembly includes at least two chambers disposed in the shroud and bounded by the rubstrip and wherein said chambers are in flow communication through at least one opening with the exterior of the stator assembly.

8. A stator assembly for a rotary machine having a substrate for a rubstrip, which comprises:

a substrate formed of a thermoplastic material which extends circumferentially with respect to the axis A;

a preformed, circumferentially extending rubstrip which is formed of a cured silicone rubber material;

a bond material which extends between the preformed silicone rubber material and the thermoplastic substrate which is formed of a layer of epoxy resin primer, a silicone rubber primer and a silicone rubber adhesive.

9. The stator assembly as claimed in claim 8 wherein the epoxy resin primer is disposed adjacent to the thermoplastic material, the silicone rubber adhesive is adjacent the preformed rubstrip formed of silicone rubber material, and said silicone rubber primer is adjacent to the epoxy resin primer and adjacent to the silicone rubber adhesive.

10. The stator assembly as claimed in claim 1 wherein the rub strip is a silicone rubber material, the shroud is a thermoplastic material, and wherein the bond material for the rubstrip is formed of layers which results from applying an epoxy resin primer to the thermoplastic material of the shroud, disposing a silicone rubber primer on the epoxy resin after the epoxy resin primer has cured, disposing a silicone adhesive paste between the silicone rubber primer and the rub strip and pressing the rub strip into place against the silicone rubber primer.

11. A method of bonding a preformed, silicone rubber article to a thermoplastic substrate comprising:

disposing a layer of epoxy resin primer on the thermoplastic substrate;

curing the epoxy resin primer;

disposing a layer of silicone rubber primer on the cured epoxy resin primer;

disposing a layer of silicone rubber adhesive between the silicone rubber article and the silicone rubber primer; and, urging the silicone rubber article toward the thermoplastic substrate to apply pressure to any layers of material between the thermoplastic substrate and the silicone rubber article and holding the pressure for a period of time.

12. The method of bonding as claimed in claim 11 wherein the step of curing the epoxy resin primer includes heating the epoxy resin primer to an elevated temperature and holding the primer at the temperature for a period of time.

13. The method of bonding as claimed in claim 11 wherein the step of disposing a silicone rubber primer includes setting the silicone rubber primer prior to contacting the silicone rubber primer with the silicone rubber adhesive.

14. The method of bonding as claimed in claim 12 wherein the step of curing the epoxy resin primer includes holding and the epoxy resin primer at a temperature of about three hundred fifty (350) degrees Fahrenheit for about one hour.

15. The method of bonding as claimed in claim 11 wherein the epoxy resin primer is applied as a fluid which includes an epoxy resin disposed in a solvent which promotes bonding between the epoxy resin and the thermoplastic material.

16. The method of bonding as claimed in claim 11 wherein the epoxy resin primer is applied in the form of a fluid and the epoxy resin primer includes epoxy resin disposed in a solvent formed of a methyl-ethyl-ketone.

17. A method of forming a stator assembly for a rotary machine, the rotary machine having an axis A and having a plurality of stator vanes extending inwardly across a working medium flowpath, the stator assembly including a silicone rubber rubstrip, comprising:

preparing an inner shroud of thermoplastic material for receiving an epoxy resin primer, the inner shroud being adapted to engage at least two of the stator vanes in the installed condition, the inner shroud having an upstream wall, a rib, and a downstream wall which extend circumferentially and which are spaced axially leaving an upstream chamber between the rib and the upstream wall and a downstream chamber between the rib and the downstream wall, the chambers extending circumferentially and each being open in the radial direction disposing a layer of epoxy resin primer on the thermoplastic substrate, the epoxy resin primer including a solvent which interacts with the thermoplastic material;

curing the epoxy resin primer;

disposing a layer of silicone rubber primer on the cured epoxy resin primer;

disposing a layer of silicone rubber adhesive between the silicone rubber rubstrip and the silicone rubber primer; and, urging the preformed silicone rubber rubstrip toward the thermoplastic substrate to apply pressure to any layers of material between the thermoplastic substrate and the silicone rubber rubstrip and holding the pressure for a period of time which includes forming a strip of bond material which attaches the rubstrip to the walls into the rib.

18. The method of forming a stator assembly of claim 17 wherein the step of forming the strip of bond material includes forming a seal between the rubstrip and the shroud which seals the opening portion of the chambers, the strip of bond material being capable of blocking the leakage of gases and wherein the shroud has at least one opening which places the chambers in flow communication with the exterior of the shroud and which adapts the stator assembly to receive pressurized gases and wherein the method includes a step of testing the strength of the bond between the shroud and the rubstrip by flowing pressurized gases into the chambers to exert a predetermined level force against the rubstrip.

19. The method of forming a stator assembly of claim 17 wherein the step of urging the preformed silicone rubber rubstrip toward the thermoplastic substrate includes deflecting the preformed rubstrip radially into the chamber bounded by the rubstrip such that a portion of the rubstrip extends radially to axially face a radially extending portion of the rib and wherein the elastomeric bond material extends radially and axially between at least part of the axially facing portions of the rib and the preformed rubstrip to increase the shearing strength at the juncture of the rubstrip and the rib.

20. The method of forming a stator assembly as claimed in claim 17 wherein the step of curing the epoxy resin primer includes heating the epoxy resin primer to an elevated temperature and holding the primer at the temperature for a period of time.

21. The method of forming a stator assembly as claimed in claim 17 wherein the step of disposing a silicone rubber primer includes setting the silicone rubber primer prior to contacting the silicone rubber primer with the silicone rubber adhesive.

22. The method of forming a stator assembly as claimed in claim 21 wherein the step of curing the epoxy resin primer includes holding the epoxy resin primer at a temperature of about three hundred fifty (350) degrees Fahrenheit for about one hour.

* * * * *